US006049294A

United States Patent [19]

Cho

[11] Patent Number: 6,049,294

[45] Date of Patent: Apr. 11, 2000

[54] APPARATUS AND METHOD FOR ADAPTABLE RECEIVING FREQUENCY SELECTION IN A REMOTE CONTROL

[75] Inventor: Jae-Seok Cho, Seoul, Rep. of Korea

[73] Assignee: Samsung Electronics Co., Ltd., Suwon, Rep. of Korea

[21] Appl. No.: 08/805,139

[22] Filed: Feb. 24, 1997

[30] Foreign Application Priority Data

Feb. 28, 1996 [KR] Rep. of Korea ..... 96-5042

[51] Int. Cl.[7] ..... G08C 19/00

[52] U.S. Cl. ..... 340/825.72; 340/825.69

[58] Field of Search ..... 340/825.69, 825.72, 340/825.73, 825.31; 455/151.2, 92, 352, 62; 359/111, 142, 147, 189, 157, 168; 364/724.01, 550; 362/233, 293; 341/176

[56] References Cited

U.S. PATENT DOCUMENTS 5,379,453 1/1995 Tigwell ..... 455/151.2
5,499,388 3/1996 Song ..... 455/62
5,506,715 4/1996 Zhu ..... 340/825.72
5,572,443 11/1996 Emoto et al. ..... 364/550
5,602,535 2/1997 Boyles et al. ..... 340/825.31

*Primary Examiner*—Michael Tokar
*Assistant Examiner*—Jean B. Jeanglaude
*Attorney, Agent, or Firm*—Burns, Doane, Swecker & Mathis, L.L.P.

[57] ABSTRACT

An adaptable receiving frequency selection apparatus for a remote controller, and a method therefor, the apparatus including a remote controller receiving module for receiving the remote control signals transmitted from the transmitting unit and passing only signals falling within a predetermined frequency range, a control unit for searching for external electromagnetic wave components existing within a carrier frequency range of the remote control signal received through the remote controller receiving module, and for selecting another frequency range exclusive of the external electromagnetic wave components as a receiving frequency range, a D/A output unit for changing the frequency range over which the remote controller receiving module can receive the remote controller signals under the control of the control unit, and a display unit for displaying the frequency range selected from the control unit.

16 Claims, 2 Drawing Sheets

APPARATUS AND METHOD FOR ADAPTABLE RECEIVING FREQUENCY SELECTION IN A REMOTE CONTROL

BACKGROUND OF THE INVENTION

1. Field of the Invention

The present invention relates to an electric household appliance using a remote controller and, more particularly to an adaptable receiving frequency selection apparatus for the remote controller capable of finding a frequency range having no external electromagnetic wave components and setting the searched frequency range for receiving the remote control signals, and a method therefor.

2. Description of the Prior Art

Recently, most electric household appliances are operated by a remote controller for the sake of a convenience in use. A remote control system includes an independently-constructed transmitting unit, and a receiving unit that is integrally formed with a remote-controlled appliance.

In operation of the remote control system, the transmitting unit encodes with predetermined protocol, remote control signals internally generated in correspondence to any key selected by a user, and then transmits infrared light signals obtained after modulating those encoded signals.

The receiving unit receives the transmitted remote control signals to convert them into the corresponding electrical signals. The converted signal is then demodulated to use in determining which sort of control commands are issued. Subsequently, a control part in the receiving unit controls various parts constituting the appliance so as to operate the appliance in compliance with the finally identified control commands.

For the above-mentioned conventional remote control system, the carrier frequency which falls within around 30–40 kHz frequency range is used in transmitting the control signals, while a ballast for a popular electric fluorescent tube also employs an oscillating frequency falling within a 20–40 kHz frequency range, like that in the remote control system.

Hereby, there is a problem in that the receiving unit may receive undesirable electromagnetic wave components, which can be generated from the fluorescent tube, as normal signals, even if the control signals issued from the transmitting unit are being transmitted towards the receiving unit. The appliance, when it erroneously receives unwanted external electromagnetic wave components instead of a normal control signal, causes a malfunction thereof, or even the system may be halted, which may occur when the unique codes of the appliance become inconsistent with the pre-set codes.

SUMMARY OF THE INVENTION

Therefore, it is an object of the present invention to provide an adaptable receiving frequency selection apparatus capable of searching for undesired external electromagnetic wave components falling within a given bandwidth including feasible carrier frequencies carrying remote control signals, selecting another usable carrier frequency rather than frequencies which the searched external electromagnetic wave components already has occupied, and informing the selected frequency of the transmitting unit, for resulting in improving of the receiving rate, further to provide a method therefor.

The above objects are accomplished by an adaptable receiving frequency selection apparatus for a remote controller which receives remote control signals transmitted from a transmitting unit, encodes the signals and then operates to control various operations of an appliance in compliance with encoded remote control signal, the apparatus comprising:

a remote controller(remocon) receiving module for receiving the remote control signals transmitted from the transmitting unit and passing only signals falling within a predetermined frequency range;

control means for searching for external electromagnetic wave components existing within a carrier frequency range of the remote control signal received through the remocon receiving module, and for selecting another frequency range exclusive of the external noise components as a receiving frequency range;

Digital-to-analog(D/A) output means for changing the frequency range over which the remocon receiving module can receive the remocon control signals, under the control of the control means; and display means for displaying the frequency range selected from the control means.

Further, according to another aspect of the present invention, a method for adjusting a frequency range over which a remocon control signal of a remote controller is transmitted is provided, wherein the method comprises the steps of:

searching for any frequency range within which external electromagnetic wave components no exists, while changing the frequency range from an upper limit to a lower limit of the frequency range;

selecting the searched frequency range absent from the external electromagnetic wave components as a frequency to be used in receiving the remote control signal, and displaying the receiving frequency; and selecting reference frequency already having been established as a receiving frequency in case the external electromagnetic wave components are throughout distributed over the span of the upper and lower limits of the overall frequency range, and displaying the receiving frequency.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

The preferred embodiment according to the present invention will now be described in detail in accordance with the accompanying drawings.

Figure 1:
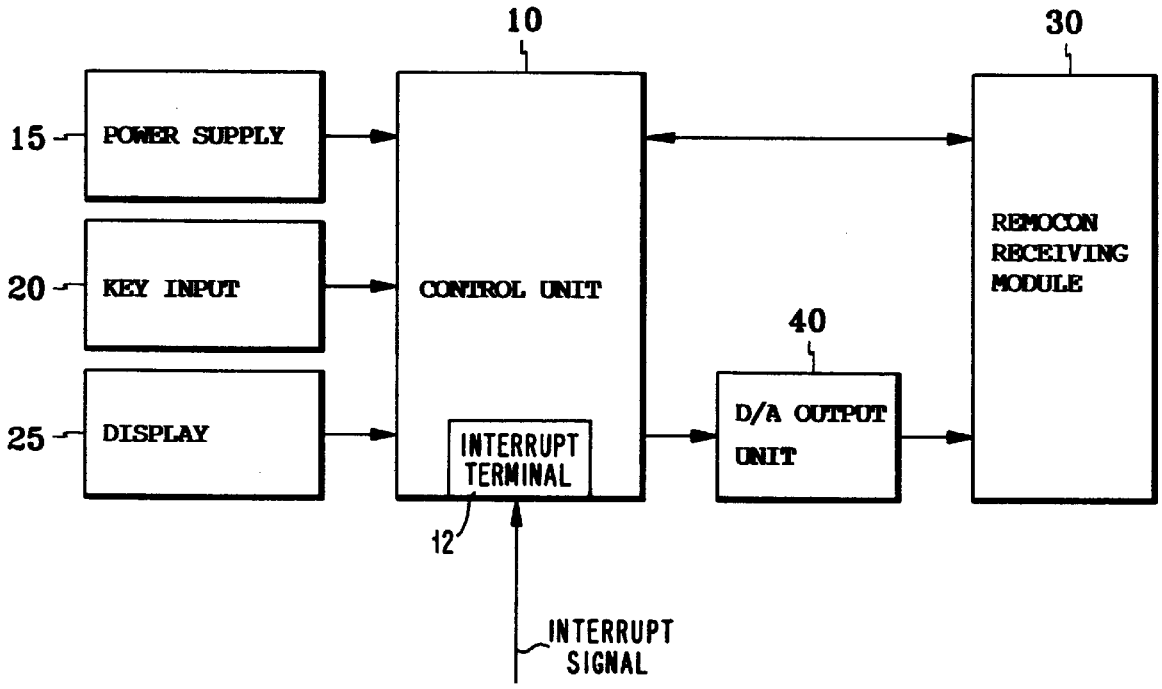
FIG. 1 is a control block diagram of a receiving frequency selection apparatus for a remote controller in accordance with one embodiment of the present invention.

As shown in FIG. 1, an adaptable receiving frequency selection apparatus according to the present invention includes a microcomputer 10(hereinafter called as control means) for controlling the general operations of an appliance, power supply means 15 for feeding the operational electric power to the control means 10, manual key input means 20 for selecting desired specific operation of appliance by a user, display means 25 for displaying various operation conditions of the appliance, as well as information relating to unoccupied free frequency range, a remote controller(also referred to as a remocon) receiving module 30 functioning to output the received remote control signals to the control means 10, and digital-to-analog(D/A) output means 40 for changing to a frequency range over which the remocon receiving module 30 can receive, under the control of the control means 10.

Figure 2:
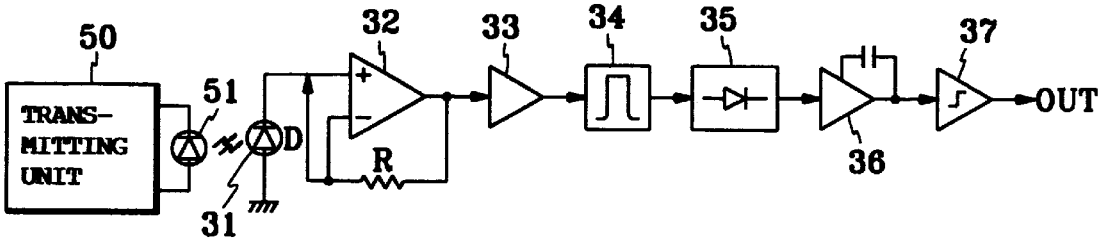
FIG. 2 is a detailed block diagram of a receiving unit applied to the present invention.

The remocon receiving module 30 includes, as shown in FIG. 2, a photo-diode 31 which receives infra-red light signals from a light emitting element 51 under the control of the transmitting unit 50 and converts them into the corresponding electric signals, an amplifier 32 for amplifying the electric signals from the photo-diode 31, a limiter 33 for removing noise components contained in higher and lower portions in amplitude of the amplified electric signals, a bandwidth pass filter(BPF) 34 for passing only signals within a predetermined frequency range, a demodulator 35 which separates the carrier component from the signals passed through the BPF 34, a waveform shaping unit 36 for shaping the demodulated pulsed waveform, and a comparator 37 for comparing a pulse width of the shaped signal with a pulse width corresponding to pre-defined logic level.

Permission range for passing the frequencies of the BPF 34 can be optimally varied by adjusting resistance of variable resistor and/or capacitance of variable capacitor both of which substantially implement the BPF 34, wherein the adjustment can be made applying analog signal converted from the D/A output means 40 in correspondence to digital signal issued from the control means 10.

The operation and advantages of such a configured apparatus according to the present invention and a method therefor will be described below.

Figure 3:
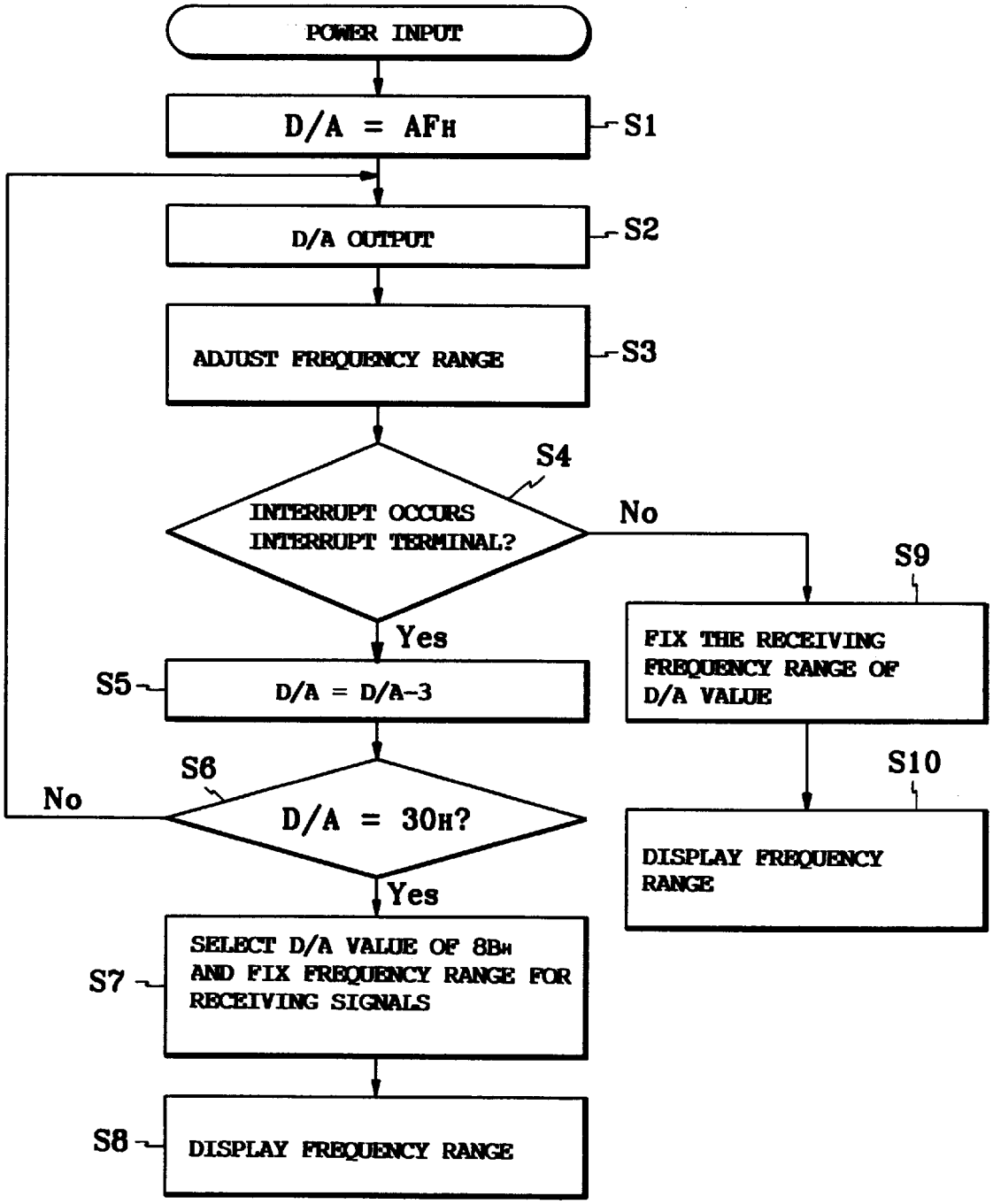
FIG. 3 is a flow chart illustrating the sequential process for selecting an optimal receiving frequency to be used in the remote controller according to the present invention.

FIG. 3 is a flow chart illustrating the sequential process for selecting an optimal receiving frequency.

The electrically powered control means 10 outputs an initial, for example, $AF_H$ valued digital signal to D/A output means 40(S1), and then D/A output means 40 converts the received signal into the corresponding analog signal and sends them to the BPF 34 in the receiving module 30(S2).

As described earlier, the frequency range of the BPF 34 is changed which frequency components of any input signals can selectively pass over(S3). At this time, the control means 10 having an interrupt terminal 12 senses if an interrupt signal is input through the above terminal so as to see whether the external electromagnetic wave components occupying the initially set frequency range are present or not.

At the decision step of S4, if the interrupt signal is input to the interrupt terminal, or an external electromagnetic wave components are present, this implies that the normally transmitted remote control signal co-exists with the external noise components, and therefore the possibility of malfunction becomes higher. Therefore, the process goes to step S5 where the control means 10 outputs any digital value decreased by, for example, 3 over the initial digital value to D/A output means 40 for changing the frequency range of the BPF 23.

Next, at step S6, it is determined whether or not the altered digital value reaches a predetermined lower limit, for example, $30_H$ of the frequency range, and if not, the process returns to step S2 in which the subsequent steps are repeated until the currently changed frequency range reaches the lower limit while searching for desired frequency range absent from the external electromagnetic wave components.

At step S6, if the changed frequency range reaches the lower limit(in case of YES), this means that the external electromagnetic wave components are throughout distributed over the span of the upper and lower limits of the frequency range. Then, the process advances to step S7 where the frequency range for receiving any informative signals is fixed with the reference value of, for example, $8B_H$ for D/A value, and then goes to step S8 in which the above-set frequency range is displayed through the display means 25.

At step S4, if the interrupt signal is not available at the interrupt terminal 12, or the external noise components no exist(in case of NO), this means that only the normally transmitted signals are present, and then the process goes to step S9 where the changed frequency range at the current step is fixedly set, and at subsequent step S10, the finally set frequency range is displayed through the display means 25.

Since the transmitting unit 50 is provided with an apparatus for changing the carrier frequency used in transferring the transmitting signal to the same frequency as the frequency displayed on the display means 25, the user sees the optimally set current frequency range which is displayed on the display means 25 and then manually changes the carrier frequency for the remote control signal by using the above-mentioned apparatus, which consequently provides the improved receiving rate.

Further, in case the receiving unit is provided with an apparatus for remotely transmitting the information relating to the optimal frequency range, and the transmitting unit is provided with an apparatus for receiving the remotely transmitted information, the carrier frequency for the remote control signal may be automatically changed to the frequency range absent from the external electromagnetic wave components without manual manipulation by the user.

As described the foregoing, the present invention has advantages of providing an improved receiving rate which results from searching for the frequency range for the remote control signal within which the external noise components occupy, changing the searched range to the different one having no noise components and informing the changed frequency range of the transmitting unit.

What is claimed is:

1. An adaptable receiving frequency selection apparatus for a remote controller which receives remote control signals transmitted from a transmitting unit and operates to control various operations of an appliance in compliance with the remote control signals, the apparatus comprising:

a remote controller receiving module for receiving the remote control signals transmitted from the transmitting unit and for passing only signals falling within a predetermined frequency range;

control means for searching for external electromagnetic wave components existing within a carrier frequency range of the remote control signal that are received through the remote controller receiving module, and for selecting another frequency range, exclusive of the external electromagnetic wave components determined to exist, as a receiving frequency range;

output means for changing the frequency range over which the remote controller receiving module can receive signals from the transmitting unit under the control of the control means; and display means for displaying the frequency range selected by the control means.

2. The apparatus as defined in claim 1, wherein the remote controller receiving module includes:

a photo-diode which receives infra-red light signals from a light emitting element under the control of the transmitting unit and converts the light signals into corresponding electric signals;

an amplifier for amplifying the electric signals from the photo-diode;

a limiter for removing noise components contained in higher and lower amplitude portions of the amplified electric signals;

a bandwidth pass filter (BPF) for passing only signals received within a predetermined frequency range;

a demodulator which separates a carrier component from the signals passed through the BPF;

a waveform shaping unit for shaping a demodulated pulsed waveform; and a comparator for comparing a pulse width of the shaped signal with a pulse width corresponding a pre-defined logic level.

3. A method for adjusting a frequency range over which a control signal of a remote controller is transmitted, the method comprising the steps of:

searching for a frequency range within which no external electromagnetic wave components exist, while searching from an upper limit to a lower limit of an operating frequency range of the remote controller;

selecting a searched frequency range devoid of external electromagnetic wave components as a receiving frequency, and displaying the receiving frequency; and alternatively selecting a reference frequency established as a receiving frequency in a case where the external electromagnetic wave components are distributed over a span of the upper and lower limits of the overall frequency range, and displaying the reference frequency.

4. The method of claim 3, wherein the step of searching for a frequency range comprises determining if an interrupt is generated, while searching the frequency range from the upper limit to the lower limit, by a predetermined discrete step and searching for whether the external electromagnetic wave components exists in the frequency range being searched during the generation of the interrupt.

5. A remote control apparatus for a remote controller, the remote control apparatus comprising:

means for determining a working frequency range which is devoid of external electromagnetic signals from a plurality of frequency ranges within a remote controller operating frequency range;

means for assigning the working frequency range to the remote controller as a receiving frequency, whereafter the remote controller operates based upon remote control information received within the working frequency range;

a remote control receiving module for receiving remote control signals transmitted by a transmitting unit, wherein the receiving module passes only those signals falling within a working frequency range.

6. The remote control apparatus of claim 5, wherein the remote control apparatus is located within an appliance and operates the appliance in accordance with the remote control information.

7. The remote control apparatus of claim 5, wherein the determining means is a control means which scans the remote controller operating frequency range, using the remote control receiving module, to determine the working frequency range.

8. The remote control apparatus of claim 5, wherein the assigning means assigns a default working frequency range to the remote controller as a receiving frequency in the event that the determining means fails to determine a working frequency range which is devoid of external electromagnetic signals.

9. The remote control apparatus of claim 5, further comprising:

display means for displaying the working frequency range.

10. The remote control apparatus of claim 5, wherein the receiving module includes:

a photo-diode that receives light signals emitted by the transmitting unit and converts the light signals into corresponding electrical signals;

an amplifier for amplifying the electrical signals; and a bandwidth pass filter for passing signals within the working frequency range.

11. An adaptable receiving frequency selection apparatus for a controller which receives remote control signals transmitted from a remote transmitting unit and controls a home appliance in compliance with the remote control signal, the apparatus comprising:

a remote control signal receiving circuit receiving electromagnetic remote control signals transmitted from the transmitting unit, and passing only signals falling within a predetermined frequency range;

a microprocessor receiving signals passed by said remote control signal receiving circuit, searches for external electromagnetic wave components existing within a carrier frequency range of the remote control signal that are received through the remote controller receiving module, and selects another frequency range, exclusive of the external electromagnetic wave components determined to exist, as a receiving frequency range;

means for changing the frequency range over which the remote control signal receiving circuit module can receive the remote control signals under the control of the microprocessor; and means for transmitting the frequency range selected by the microprocessor outside said apparatus to permit said transmitted unit to adopt said selected frequency range.

12. The apparatus as defined in claim 11, further comprising means for transmitting the frequency range selected by the microprocessor outside said apparatus to permit said transmitted unit to adopt said selected frequency range.

13. The apparatus as defined in claim 12, wherein said transmitting means includes a display device.

14. The apparatus as defined in claim 12, wherein said transmitting means includes electromagnetic wave transmitter which transmits a signal to the remote transmitting unit.

15. The apparatus as defined in claim 11, wherein the remote control signal receiving circuit includes a photo-conversion element which receives infra-red light signals from a light emitting element under the control of the transmitting unit and converts the light signals into corresponding electric signals.

16. The apparatus as defined in claim 11, wherein the remote control signal receiving circuit receives electromagnetic signals in the 30–40 kHz range.

* * * * *